United States Patent [19]

Stern et al.

[11] Patent Number: 4,887,054

[45] Date of Patent: Dec. 12, 1989

[54] COMPACT MICROSTRIP LATCHING RECIPROCAL PHASE SHIFTER

[75] Inventors: Richard A. Stern, Allenwood; Richard W. Babbitt, Fair Haven, both of N.J.

[73] Assignee: The United States of America as represented by the Secretary of the Army, Washington, D.C.

[21] Appl. No.: 290,719

[22] Filed: Dec. 23, 1988

[51] Int. Cl.[4] ..... H01P 1/195

[52] U.S. Cl. ..... 333/158; 333/162; 333/238

[58] Field of Search ..... 333/24.1, 158, 161, 333/162

[56] References Cited

U.S. PATENT DOCUMENTS

| | | | |
|---|---|---|---|
| 2,721,312 | 10/1955 | Greig et al. | 333/238 |
| 3,277,401 | 10/1966 | Stern | 333/24.1 |
| 3,290,622 | 12/1966 | Hair | 333/24.1 |
| 3,418,605 | 12/1968 | Hair et al. | 333/24.1 |

*Primary Examiner*—Paul Gensler

*Attorney, Agent, or Firm*—Michael Zelenka; Robert A. Maikis

[57] ABSTRACT

A latching type of microstrip reciprocal phase shifter is provided having a toroidal-shaped ferrite core with a length of microstrip conductor wound about the outer cylindrical surface of the core and a ground plane mounted on the inner cylindrical surface of the core surrounding the aperture in the core. A single control wire is passed through the aperture in the core and creates a circular magnetic field in the core surrounding the aperture when the core is pulsed with a unidirectional current pulse. By successively pulsing the control wire with current pulses of opposite polarity, the core may be switched back and forth between a first saturated magnetic state in which it exhibits a first insertion phase with respect to millimeter wave energy traveling between the ends of the microstrip conductor disposed on the outer cylindrical surface of the core and a second non-saturated magnetic state in which it exhibits a different insertion phase with respect to such millimeter wave energy traveling along the microstrip conductor on the outer surface of the core.

4 Claims, 2 Drawing Sheets

COMPACT MICROSTRIP LATCHING RECIPROCAL PHASE SHIFTER

STATEMENT OF GOVERNMENT RIGHTS

The invention described herein may be manufactured, used and licensed by or for the Government for governmental purposes without the payment to us of any royalties thereon.

BACKGROUND OF THE INVENTION

1. Field of the Invention

This invention relates to microstrip transmission lines and microstrip transmission line components operating in the millimeter wave region of the frequency spectrum and more particularly to a compact, latching type of microstrip reciprocal phase shifter for use with such microstrip transmission lines and microstrip components.

2. Description of the Prior Art

Reciprocal phase shifters are devices employed to perform a reciprocal phase shift function in many types of RF circuits. In the millimeter wave region of the frequency spectrum, for example, reciprocal phase shifters are employed with phases antenna arrays for radar and communications applications. Additionally, reciprocal phase shifters are utilized in millimeter wave applications as 4-port switchable circulators, power dividers and switches. Since much of the equipment in this region of the frequency spectrum is being designed with planar circuitry utilizing microstrip transmission lines and components because of the substantial savings in size and weight realized, it is essential that microstrip reciprocal phase shifters are available which are capable of being used with this equipment.

In U.S. patent application Ser. No. 152,206, now U.S. Pat. No. 4,816,787, which was filed Feb. 3, 1988 by Richard A. Stern and Richard W. Babbitt, the same applicants as the applicants of the present application, and which was assigned to the same assignee as the assignee of the present application, a microstrip reciprocal phase shifter is described which is especially suited for use with microstrip transmission lines and microstrip components in the millimeter wave region of the frequency spectrum. The phase shifter disclosed therein utilized a rectangular ferrite rod which was mounted on one surface of a length of microstrip transmission line dielectric substrate having an electrically conductive ground plane on the other surface of the substrate. A pair of ramp-shaped transition members were disposed at the ends of the ferrite rod and a length of microstrip conductor was mounted on the top surfaces of the rod, rampshaped members and the substrate and extended from one end of the substrate to the other. A helical coil which extended along the length of the rod and which encircled the microstrip conductor, the rod and the substrate ground plane was energized with a d.c. voltage to produce a unidirectional magnetic field extending along the longitudinal axis of the rod so that the rod functioned as a Reggia-Spencer type of ferrite phase shifter with respect to RF wave energy traveling down the length of microstrip dielectric substrate and passing through the ferrite rod. However, this phase shifter was a non-latching reciprocal phase shifter which required a continuous holding current to maintain a given phase set. Accordingly, for some applications, it would be desirable to have a latching type of microstrip reciprocal phase shifter which would require only the application of a single current pulse to shift the phase shifter from one insertion phase to another insertion phase to thereby produce the desired phase shift. Additionally, it would be desirable to make the phase shifter even more compact by reducing the overall length of the device because the length of the device becomes important when dealing with the microstrip transmission line mode of wave propagation. Finally, it would be desirable to replace the bulky helical coil with a more compact, faster acting control device.

SUMMARY OF THE INVENTION

It is an object of this invention to provide a latching type of microstrip reciprocal ferrite phase shifter which is suitable for use in the millimeter wave region of the frequency spectrum.

It is a further object of this invention to provide a microstrip reciprocal phase shifter which is of more compact size and lower weight and which has a shorter length than the microstrip reciprocal phase shifter shown and described in U.S. patent application Ser. No. 152,206.

It is a still further object of this invention to provide a microstrip reciprocal phase shifter which has a faster response time and is of more simple construction and easier to fabricate than the microstrip reciprocal phase shifter shown and described in said U.S. patent application Ser. No. 152,206.

It is another object of this invention to provide a latching type of millimeter wave microstrip reciprocal ferrite phase shifter which is especially suited for use in microstrip phased antenna arrays for radar and communications applications.

Briefly, the microstrip latching reciprocal phase shifter of the invention comprises a toroidal-shaped ferrite core having a cylindrical outer surface and a cylindrical inner surface defining the aperture of the toroidal-shaped core. An electrically conductive cylindrical ground plane is mounted on and is concentric with the inner surface of the toroidal-shaped core. A length of electrically conductive microstrip conductor is mounted on the outer surface of the toroidal-shaped core and extends around at least a portion of the circumference of the core outer surface. Finally, the phase shifter of the invention includes selectively operable control current pulse responsive control wire means disposed in and extending through the aperture in the toroidal-shaped core for latching the core into either a first saturated magnetic state in which a circular unidirectional magnetic field is created in the core surrounding the aperture in the core or a second non-saturated magnetic state in which a circular unidirectional magnetic field is created in the core surrounding the aperture in the core, whereby the core exhibits a different insertion phase in each of the first and second magnetic states with respect to electromagnetic wave energy propagated through the core from one end of the length of microstrip conductor to the other end of the length of microstrip conductor.

The nature of the invention and other objects and additional advantages thereof will be more readily understood by those skilled in the art after consideration of the following detailed description taken in conjunction with the accompanying drawings.

DESCRIPTION OF THE PREFERRED EMBODIMENT OF THE INVENTION

Figure 1:
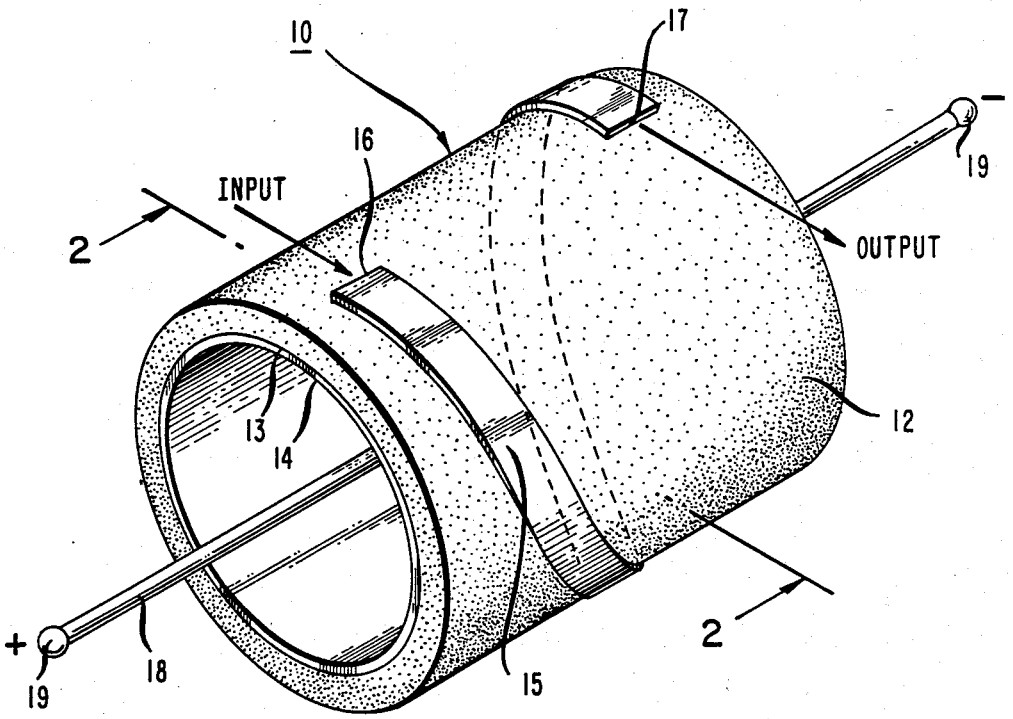
FIG. 1 is a perspective view of the microstrip latching reciprocal phase shifter of the invention.
Figure 2:
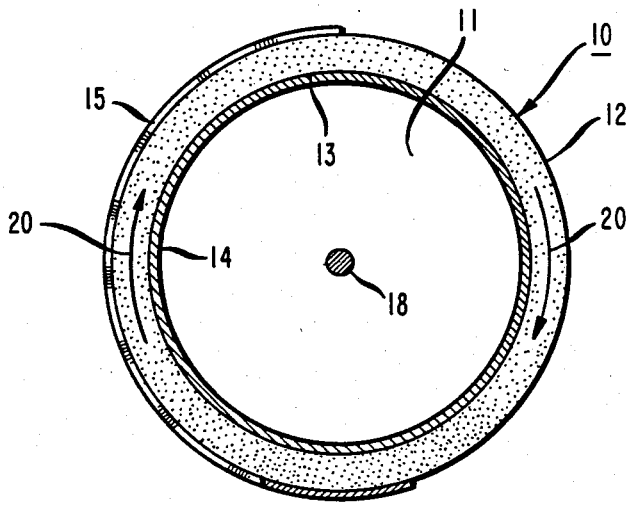
FIG. 2 is a full sectional view of the phase shifter of FIG. 1 taken along the line 2—2 of FIG. 1.

Referring now to FIGS. 1 and 2 of the drawings, there is shown a microstrip latching reciprocal phase shifter constructed in accordance with the teachings of the present invention comprising a toroidal-shaped ferrite core, indicated generally as 10, which has an aperture 11 extending therethrough. The ferrite core 10 has a cylindrical outer surface 12 and a cylindrical inner surface 13. The inner core surface 13 defines the aperture 11 of the toroidal-shaped core. The core 10 is fabricated of a ferrite material, such as nickel zinc ferrite or lithium zinc ferrite, for example, which exhibits gyromagnetic behavior in the presence of a unidirectional magnetic field.

An electrically conductive cylindrical ground plane 14 is mounted on and is concentric with the inner surface 13 of the toroidal-shaped core 10. A length of electrically conductive microstrip conductor 15 having ends 16 and 17 is mounted on the outer surface 12 of the core 10 and extends around at least a portion of the circumference of the core outer surface. As illustrated in FIGS. 1 and 2, the length of microstrip conductor 15 extends substantially around the full 360 degree circumference of the outer surface 12 of the toroidal-shaped core 10 and is helically wound about the core outer surface so that after traversing the entire circumference of the outer surface of the core, the ends 16 and 17 of the length of microstrip conductor do not abut each other but instead are spaced apart a distance along the axis of rotation of the toroidal-shaped core. Both the ground plane 14 and the length of microstrip conductor 15 should be fabricated of a good electrically conductive metal, such as copper or silver, for example.

As seen in FIGS. 1 and 2 of the drawings, a single control wire 18 is disposed in and extends through the aperture 11 in the toroidal-shaped core 10. The control wire 18 has terminals 19 to which may be applied a control voltage. When a d.c. control voltage having the polarity shown in FIG. 1 of the drawings is applied to the terminals 19, the control current flowing through the control wire 18 will produce a circular unidirectional magnetic field in the toroidal-shaped core 10 surrounding the aperture 11 of the core as represented schematically by the arrows 20 in FIG. 2. It should be noted that although control wire 18 is shown as extending along the axis of rotation of the toroidal-shaped core in FIGS. 1 and 2 of the drawings, it is not necessary that it does so. It is only necessary that the control wire 18 is disposed in and passes through the aperture 11 of the core. Accordingly, when the device is fabricated, the control wire 18 may be affixed to the ground plane 14 by a suitable epoxy or other type of adhesive if the control wire 18 is, of course, covered with electrical insulation.

Figure 3:
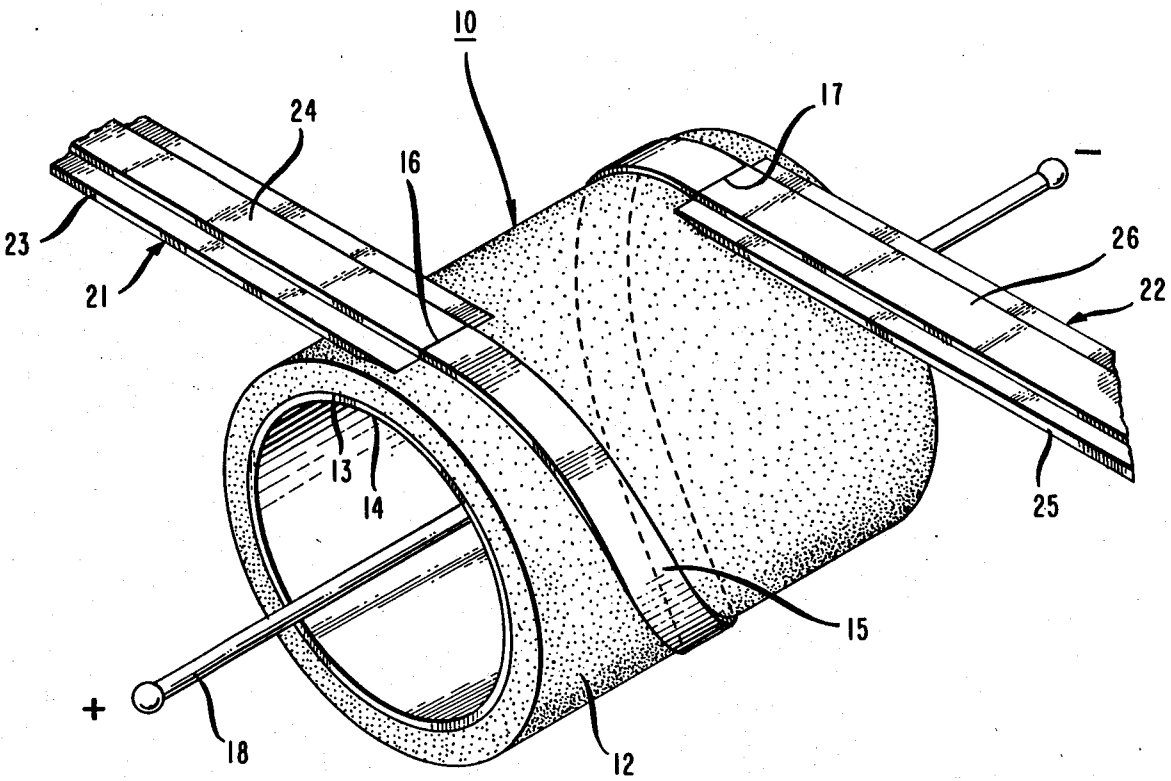
FIG. 3 is a perspective view of the phase shifter of FIGS. 1 and 2 showing one method of coupling the phase shifter to microstrip transmission lines.

Referring now to FIG. 3 of the drawings, one method of coupling the microstrip reciprocal phase shifter of the invention to planar circuitry designed in the microstrip transmission line medium is illustrated. As seen therein, a first section of microstrip transmission line, indicated generally as 21, is coupled to the input end 16 of the microstrip conductor length 15 which is wound on the outer cylindrical surface 12 of the toroidal-shaped core 10. A second section of microstrip transmission line, indicated generally as 22, is coupled to the other end 17 of the conductor length 15. Both of the sections 21 and 22 of microstrip transmission line are fabricated in a well-known manner and comprise a length of microstrip dielectric substrate having an electrically conductive ground plane on one side thereof and a length of microstrip conductor on the other side thereof. When an electromagnetic wave signal, such as a millimeter wave signal, for example, is applied to a microstrip transmission line of this type and is properly oriented with respect to the line, the signal will be propagated along the length of the transmission line. The theory of operation of this mode of signal transmission is well-known in the art and will not be described further herein.

Section 21 of microstrip transmission line has a dielectric substrate 23 with a section 24 of microstrip conductor mounted on the top surface thereof. The ground plane for this section of microstrip transmission lines is not visible in the view of FIG. 3. It will be noted that the section 24 of microstrip conductor has its end abutting the end 16 of the microstrip conductor section 15 which is wound about the outer surface of the core 10 and that the top surface of the substrate 23 is disposed tangentially with respect to the cylindrical outer surface 12 of the core 10 so that a relatively smooth transition is provided between the microstrip conductor lengths 24 and 15. Similarly, the second section of microstrip transmission line 22 has a dielectric substrate 25 having a length 26 of microstrip conductor mounted on the top surface thereof and a ground plane (not visible) on the bottom surface thereof. Again, the end of microstrip conductor length 26 is arranged to abut the end 17 of the microstrip conductor length 15 which is wound about the outer surface of the core 10 and the top surface of the substrate 25 is tangentially disposed with respect to the cylindrical outer surface 12 of the core 10. Since the toroidal-shaped core 10 has a microstrip conductor length 15 wound about its outer surface 12 and since there is an electrically conductive ground plane 14 mounted on the inner surface 13 of the core, the dielectric properties of the ferrite material of which the core is fabricated enable the core itself to function as a cylindrical microstrip transmission line with respect to electromagnetic wave energy traveling along microstrip conductor length 15 from input end 16 to output end 17 thereof. However, since the dielectric constant of the material of which the ferrite core is fabricated is substantially greater than the dielectric constant of the material of which the substrates 23 and 25 of microstrip transmission line sections 21 and 22, respectively, the mode of wave propagation of the signal through the core 10 changes from the microstrip transmission line mode of propagation to the dielectric waveguide mode of operation. For example, the dielectric substrate material of which the microstrip transmission line sections 21 and 22 are fabricated is usually a material such as Duroid which has a dielectric constant of 2.2, whereas the dielectric constant of nickel zinc ferrite or lithium zinc ferrite is 13.

In operation, since the toroidal-shaped core 10 is "sandwiched" between the electrically conductive ground plane 14 of the core and the microstrip conductor length 15 which is wound about the outer surface of the core, when the core 10 is subjected to a unidirectional circular magnetic field around the aperture 11 of the core, the core will function as a reciprocal phase shifter because of the suppressed rotation or Reggia-Spencer effect in substantially the same manner as the rectangular ferrite rod type of reciprocal phase shifter described in said U.S. patent application Ser. No. 152,206 which was filed by the inventors of the present application. However, unlike the ferrite rod type of microstrip reciprocal phase shifter disclosed in said U.S. patent application Ser. No. 152,206, the microstrip reciprocal phase shifter disclosed and claimed in the present application is a latching type of phase shifter because a closed, circular flux path is provided for the unidirectional magnetic field required to actuate the phase shifter. Since the ferrite material of the core has a "square" hysterisis loop, the core 10 may be latched and held in either of two magnetic states by the application of a single unidirectional current pulse through the control wire 18. In practice, the control wire 18 is pulsed a sufficient number of times with current pulses of one polarity to drive the core 10 to saturation at one "end" of the hysterisis loop. In this first magnetic state, the core 10 will exhibit a first insertion phase with respect to electromagnetic wave energy propagated through the core from one end of the length of microstrip conductor 15 to the other end thereof. When the control wire 18 is then subjected to a current pulse of opposite polarity, the direction of the circular magnetic field 20 in the core will be reversed and the core will be driven to a second magnetic state in which the core 10 exhibits a different insertion phase than it exhibited in the first magnetic state. The difference between these two insertion phases constitutes the amount of phase shift given to the applied RF electromagnetic wave signal by the toroidal-shaped core phase shifter. It is important to note, however, that only one of the two magnetic states to which the core may be driven may be a saturated magnetic state because if the core were driven to saturation at opposite ends of its hysterisis loop, there would be no phase shift because the insertion phase exhibited by a reciprocal type of phase shifter at both ends of its hysterisis loop would be the same and the net phase shift would be zero. Accordingly, the latching type of reciprocal phase shifter of the invention may be shifted from one of the first and second magnetic states to the other of the first and second magnetic states by the application to the terminals of the single control wire 18 of successive control current pulses having opposite polarity with respect to each other.

By virtue of the toroidal-shape of the core 10 of the phase shifter of the invention, the functions of a microstrip reciprocal phase shifter of the ferrite rod type may be incorporated into a structure which is not only more compact but which may be more easily fabricated because of the simpler construction of the device. For example, a ferrite rod type of reciprocal phase shifter having a length of 1.25 inches may be replaced by a 0.4 inch diameter ferrite toroid which would also have a 1.25 inch circumferential path around its outer cylindrical surface. Accordingly the linear length which would be occupied by the toroidal-shaped version of the reciprocal ferrite phase shifter would be reduced by about 68%. Since the reciprocal phase shifter of the present application is of the latching type and requires only a single turn of wire through the aperture 11 in the core 10, it is obviously more simple to fabricate than the ferrite rod type of microstrip phase shifter which requires a helical coil which is wound about the length of the ferrite rod. Additionally, the single turn of wire and the pulse type of operation enables the phase shifter of the invention to operate with a faster response time than the ferrite/rod type. It may also be noted that since the total length of the path through a ferrite reciprocal phase shifter determines the total amount of phase shift available from a given device, the length of the circular path around the toroidal-shaped ferrite core of the phase shifter of the invention may be increased by increasing the number of revolutions of the microstrip conductor 15 around the cylindrical outer surface 12 of the core 10. For example, if an insufficient total phase shift is available when the length 15 of microstrip conductor extends substantially around the full 360 degree circumference of the outer surface 12 of the core 10, the conductor 15 may extend around the full 360 degree circumference of the outer surface of the core more than once, i.e., one and one-half or two times around the full circumference. Although for some applications, sufficient phase shift may be available if the microstrip conductor length 15 does not extend entirely around the full 360 degree circumference of the core 10, it may be desirable for practical reasons of fabrication to have it do so because this will permit the input and output sections of microstrip transmission lines which are connected to the toroidal-shaped phase shifter to be located at the same circumferential location on the periphery of the phase shifter core and would thereby facilitate incorporation of the phase shifter into a planar circuit. In this regard, it may be noted that for some applications, the microstrip transmission line sections 21 and 22 shown in FIG. 3 of the drawings may be turned upside-down as seen in that figure of the drawings so that the ground plane side of the dielectric substrates of these sections of the microstrp transmission lines would be located on the top surface rather than the bottom surface of the substrates. The microstrip conductor lengths 24 and 26 of these sections of microstrip transmission line would then be on the bottom side of the substrates. This arrangement would permit both of the microstrip transmission line sections 21 and 22 to be fabricated on a single width or piece of dielectric transmission line substrate.

It is believed apparent that many changes could be made in the construction and described uses of the foregoing microstrip latching reciprocal phase shifter and many seemingly different embodiments of the invention could be constructed without departing from the scope thereof. For example, although the phase shifter has been described with reference to use in the millimeter wave region of the frequency spectrum, it is apparent that the shifter is not limited in use to applications solely in this frequency region. Accordingly, it is intended that all matter contained in the above description or shown in the accompanying drawings shall be interpreted as illustrative and not in a limiting sense.

What is claimed is:

1. A compact microstrip latching reciprocal phase shifter comprising a toroidal-shaped ferrite core having a cylindrical outer surface, and a cylindrical inner surface defining the aperture of the toroidal-shaped core;

an electrically conductive cylindrical ground plane mounted on and concentric with said inner surface of said toroidal-shaped core;

a length of electrically conductive microstrip conductor mounted on said outer surface of said toroidal-shaped core and extending around at least a portion of the circumference of said core outer surface; and selectively operable control current pulse responsive control wire means disposed in and extending through said aperture in said toroidal-shaped core for latching said core into either a first saturated magnetic state in which a circular unidirectional magnetic field is created in said core surrounding said aperture in said core or a second non-saturated magnetic state in which a circular unidirectional magnetic field is created in said core surrounding said aperture in said core, whereby said core exhibits a different insertion phase in each of said first and second magnetic states with respect to electromagnetic wave energy propagated through said core from one end of said length of microstrip conductor to the other end of said length of microstrip conductor.

2. A compact microstrip latching reciprocal phase shifter as claimed in claim 1 wherein said selectively operably control wire means comprises a single control wire disposed in and extending through said aperture in said core, so that said core may be shifted from one of said first and second magnetic states to the other of said first and second magnetic states by the application to the terminals of said single control wire of successive control current pulses having opposite polarity with respect to each other.

3. A compact microstrip latching reciprocal phase shifter as claimed in claim 2 wherein said length of microstrip conductor extends substantially around the full 360 degree circumference of said outer surface of said toroidal-shaped core and is helically wound about said core outer surface.

4. A compact microstrip latching reciprocal phase shifter as claimed in claim 3 wherein said length of microstrip conductor extends around the full 360 degree circumference of said outer surface of said toroidal-shaped core more than once.

* * * * *